US005606755A

United States Patent [19]

Romein

[11] Patent Number: 5,606,755

[45] Date of Patent: Mar. 4, 1997

[54] LIGHT-WEIGHT MASSAGE TABLE

[76] Inventor: Daniel C. Romein, 3140 Roy Messer Hwy., White Pine, Tenn. 37890

[21] Appl. No.: 417,518

[22] Filed: Apr. 5, 1995

[51] Int. Cl.[6] ..... A47B 7/00

[52] U.S. Cl. ..... 5/620; 5/306; 5/740

[58] Field of Search ..... 5/620, 652, 481, 5/181, 185, 663, 933, 306; 108/90, 27; 248/440, 439; 52/223.6, 650.3, 654.1

[56] References Cited

U.S. PATENT DOCUMENTS

| | | | |
|---|---|---|---|
| 464,644 | 12/1891 | Busbea | 5/306 |
| 512,092 | 1/1894 | Bernheim | 5/306 |
| 2,167,342 | 7/1939 | York . | |
| 2,533,787 | 12/1950 | Gebhart | 5/620 |
| 2,713,892 | 7/1955 | Knapp | 5/481 |
| 4,106,138 | 8/1978 | Murphy | 5/181 |
| 4,333,638 | 6/1982 | Gillotti et al. . | |
| 4,514,871 | 5/1985 | Fisher | 5/663 |
| 4,833,998 | 5/1989 | Everett et al. . | |
| 4,927,128 | 5/1990 | O'Brien . | |
| 4,943,041 | 7/1990 | Romein . | |
| 5,335,676 | 8/1994 | O'Brien . | |

FOREIGN PATENT DOCUMENTS

| | | | |
|---|---|---|---|
| 360733 | 3/1990 | European Pat. Off. | 5/481 |

*Primary Examiner*—Flemming Saether

[57] ABSTRACT

A massage table having a sheet member including a perimeter and a lower surface opposite an upper surface. Stiffeners are positioned adjacent to the perimeter and the lower surface, and a plurality of elongated padding members having a polygonal cross-section are provided. Each padding member is positioned adjacent to one of the edge members and longitudinally aligned with the length axis of the adjacent edge member. A lower longitudinal edge of the padding member is adjacent to and aligned with the lower longitudinal edge of the adjacent edge member, and an upper surface thereof is positioned parallel to the upper surface of the support member. One or more tensile members diagonally connect two or more points about the perimeter, the tensile members crossing proximate the center of said sheet member. Compression structure spans between the lower surface and an intersecting region of the tensile members.

16 Claims, 14 Drawing Sheets

LIGHT-WEIGHT MASSAGE TABLE

FIELD OF THE INVENTION

This invention relates generally to massage tables. More particularly, this invention relates to portable, light-weight massage tables wherein reduction in weight is achieved without a corresponding reduction in structural integrity.

BACKGROUND OF THE INVENTION

Massage therapists who travel from location to location typically transport a portable massage table from location to location. Thus, weight and portability are desirable features to users of such massage tables. Portable massage table construction typically compromises size and strength in favor of reduced weight. Accordingly, there is a need in the art for a portable massage table having decreased weight without a corresponding loss of strength and size.

It is an object of the present invention to provide a portable massage table that is light-weight and sturdy.

Another object of the present invention is to provide a massage table of the character described having a larger table top area without a significant corresponding weight increase.

A further object of the present invention is to provide a massage table of the character described which offers improved use benefits and facilitates massage therapy.

An additional object of the present invention is to provide a massage table of the character described which is uncomplicated in configuration and economical.

SUMMARY OF THE INVENTION

Having regard to the foregoing and other objects, the present invention is directed to a massage table comprising a sheet member including a perimeter, a lower surface opposite an upper surface, and stiffeners about the perimeter and adjacent the lower surface. A plurality of elongated padding members each having a polygonal cross-section are provided, each padding member being positioned adjacent to one of the edge members and having a length axis aligned with the length axis of the adjacent edge member. Each padding member also includes a lower longitudinal edge adjacent to and aligned with the lower longitudinal edge of the adjacent edge member and an upper surface positioned parallel to the upper surface of the support member.

The wedge-shaped members are preferably triangular in cross-section and advantageously enable the production of a larger table without an increase in frame size and without a significant increase in weight.

In another aspect, the invention provides a massage table with a table top having stiffeners about the perimeter thereof and adjacent the lower surface of the table top. One or more tensile members diagonally connect two or more points about the perimeter, the tensile members crossing proximate the center of the sheet member. Compression structure spans between the lower surface and an intersecting region of the tensile members.

The tensile members permit force to be exerted upon the table top to advantageously enable the use of thinner and lighter weight materials without compromising strength and rigidity.

BRIEF DESCRIPTION OF THE DRAWINGS

The above and other features and advantages of the present invention will become further known from the following detailed description when considered in conjunction with the accompanying drawings in which:

FIG. 16 is a perspective view of the table of FIG. 14 having included therewith a table top having a tensioning system in accordance with the present invention.

DETAILED DESCRIPTION

Figure 1:
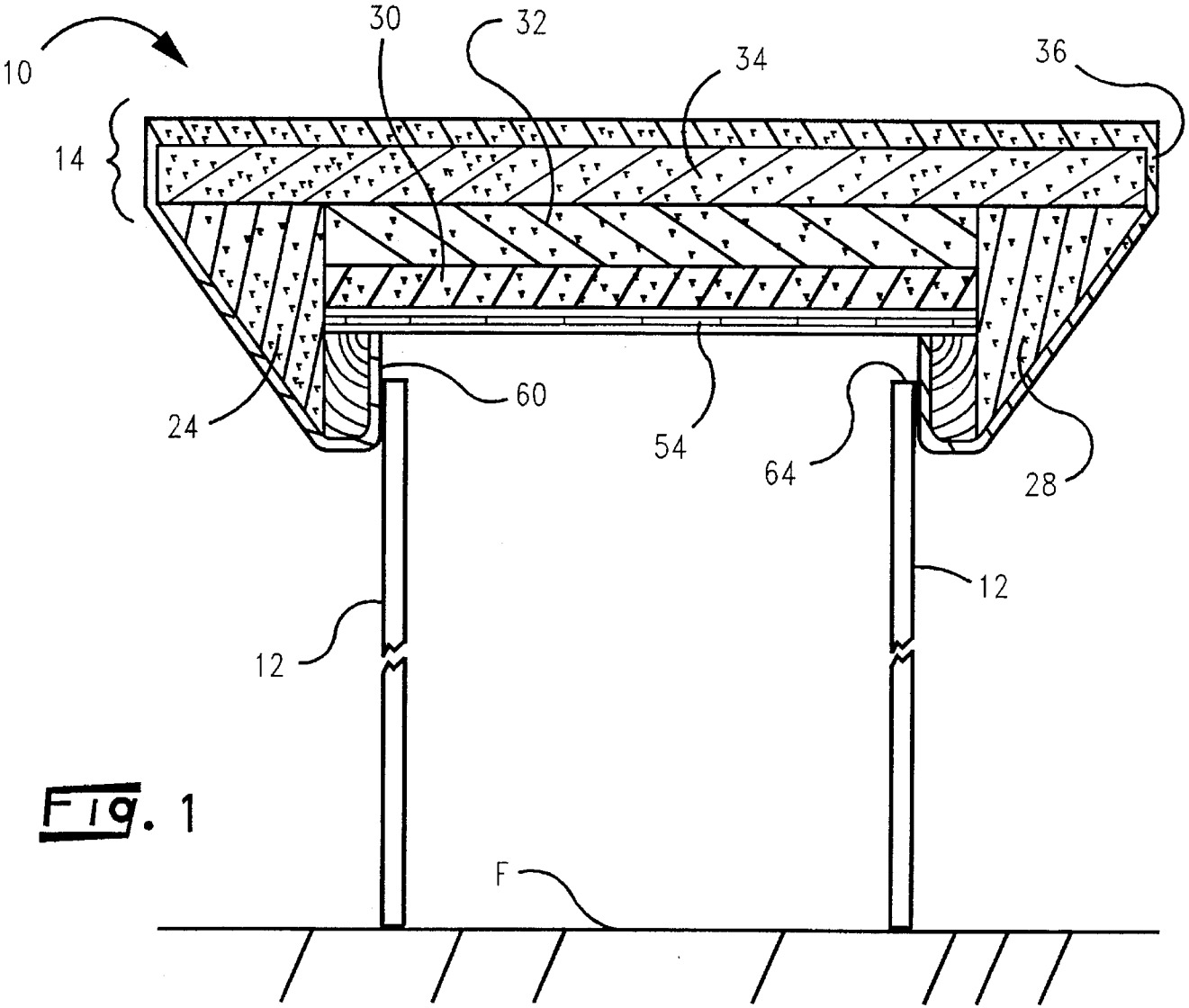
FIG. 1 is a cross-sectional view of a preferred embodiment showing a massage table in accordance with the present invention.
Figure 2A:
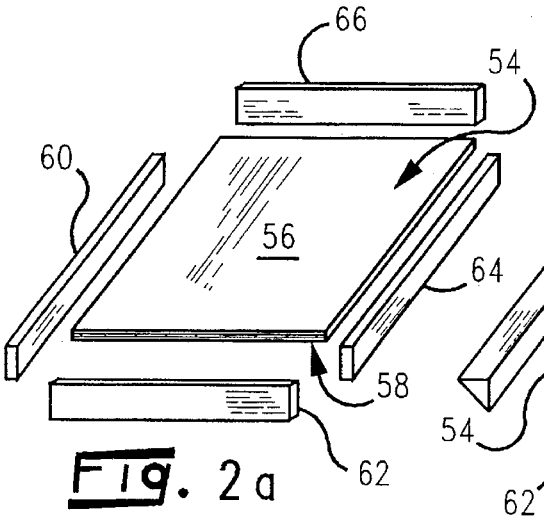
FIGS. 2(*a*)–2(*d*) are perspective views showing construction aspects of a massage table in accordance with the invention.
Figure 2C:
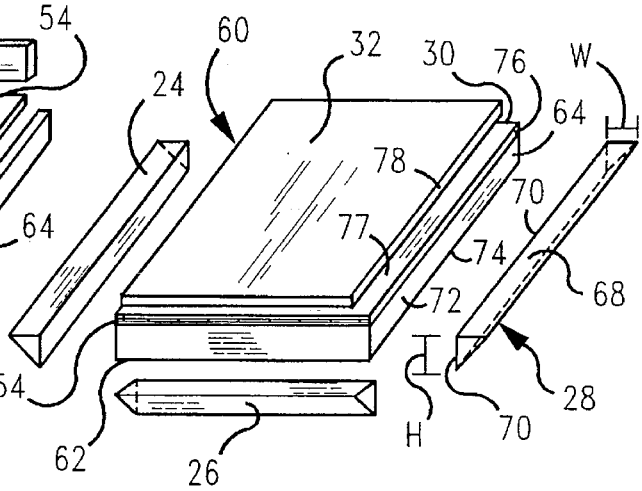
Figure 2B:
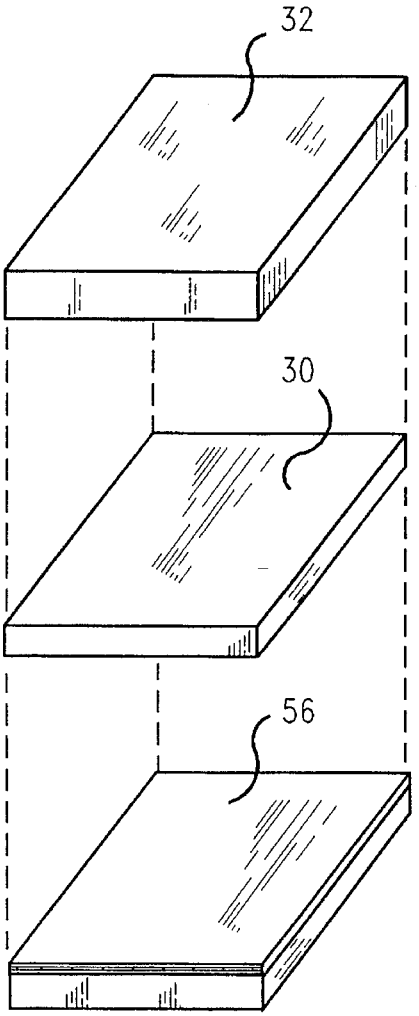
Figure 2D:
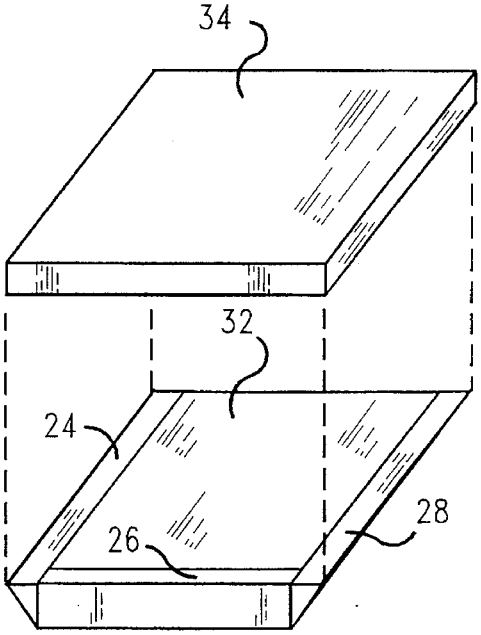

Referring now to the drawings in which like characters refer to like parts throughout the several views, FIGS. 1 through 5 show a massage or therapy table 10 embodying the present invention. Dimensions are provided in the description for example only. The table 10 includes a plurality of legs 12 and a table top 14 supported by the legs 12.

The legs 12 are preferably foldably positionable relative to the table top 12 and of adjustable length so that the height of the table top relative to the floor F may be adjusted to the user's preference and comfort. An example of a suitable folding and adjustable leg is the telescoping leg described in Applicant's U.S. Pat. No. 4,943,041, entitled LIGHT- WEIGHT FOLDING MASSAGE TABLE, the entire disclosure of which is incorporated herein by reference.

Figure 3:
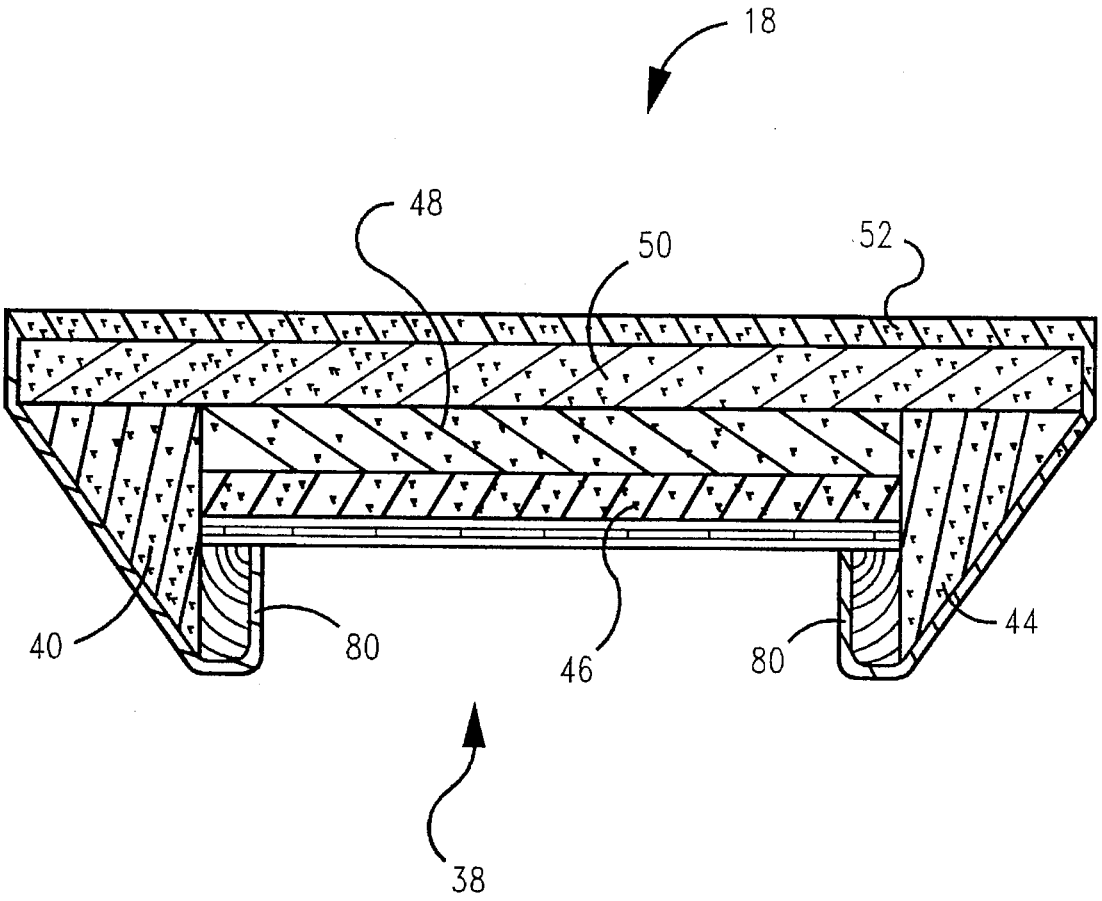
FIG. 3 is an enlarged cross-sectional view of a section of the massage table of FIG. 1.
Figure 4:
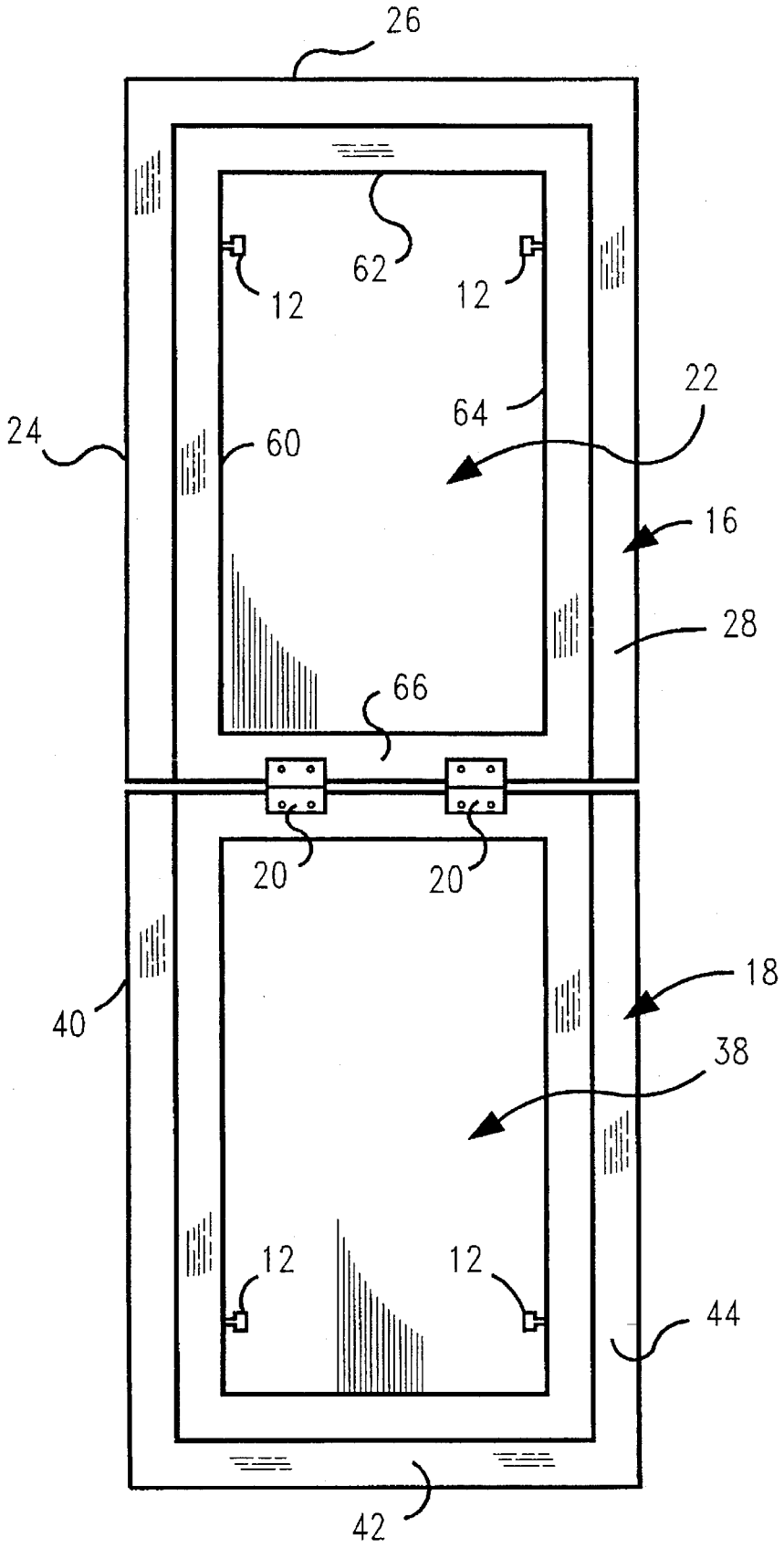
FIG. 4 is a bottom plan view of the massage table of FIG. 1.
Figure 5A:
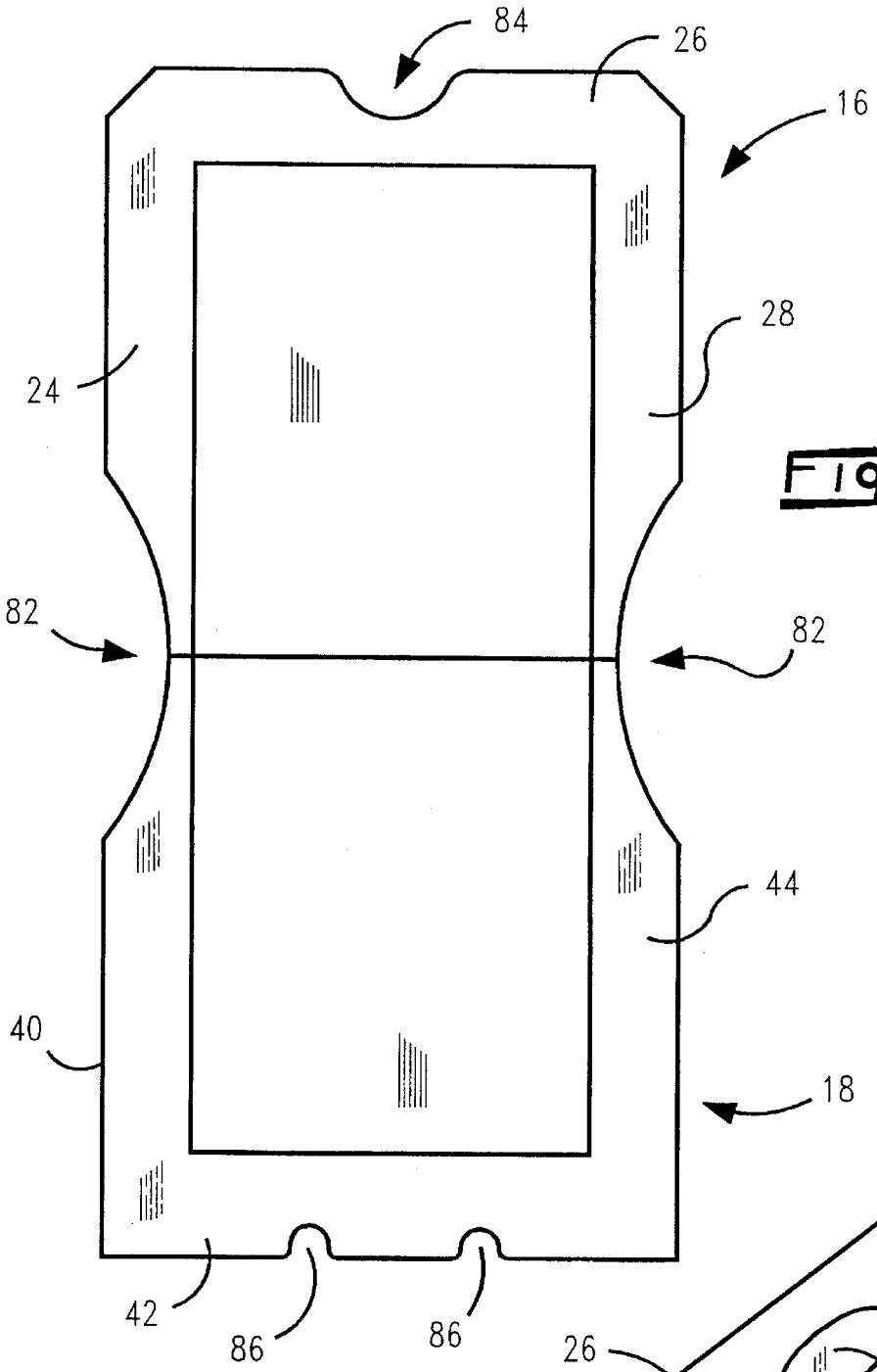
FIG. 5*a* is a top plan view of a massage table having cutouts for improved comfort and usability and FIG. 5*b* is a perspective view of padding having a cutout.
Figure 5B:
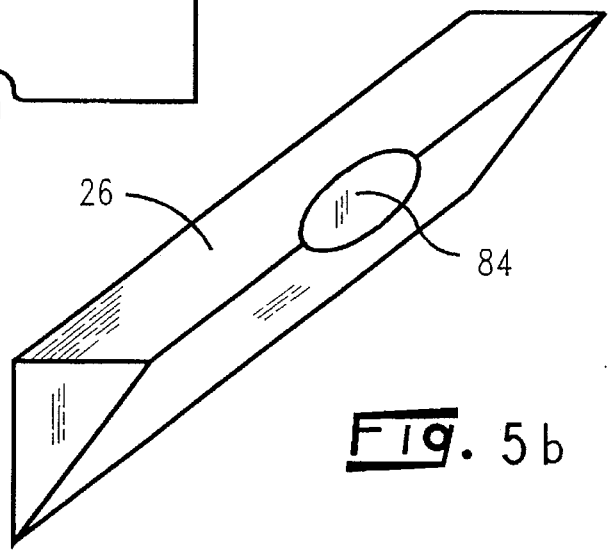
Figure 6:
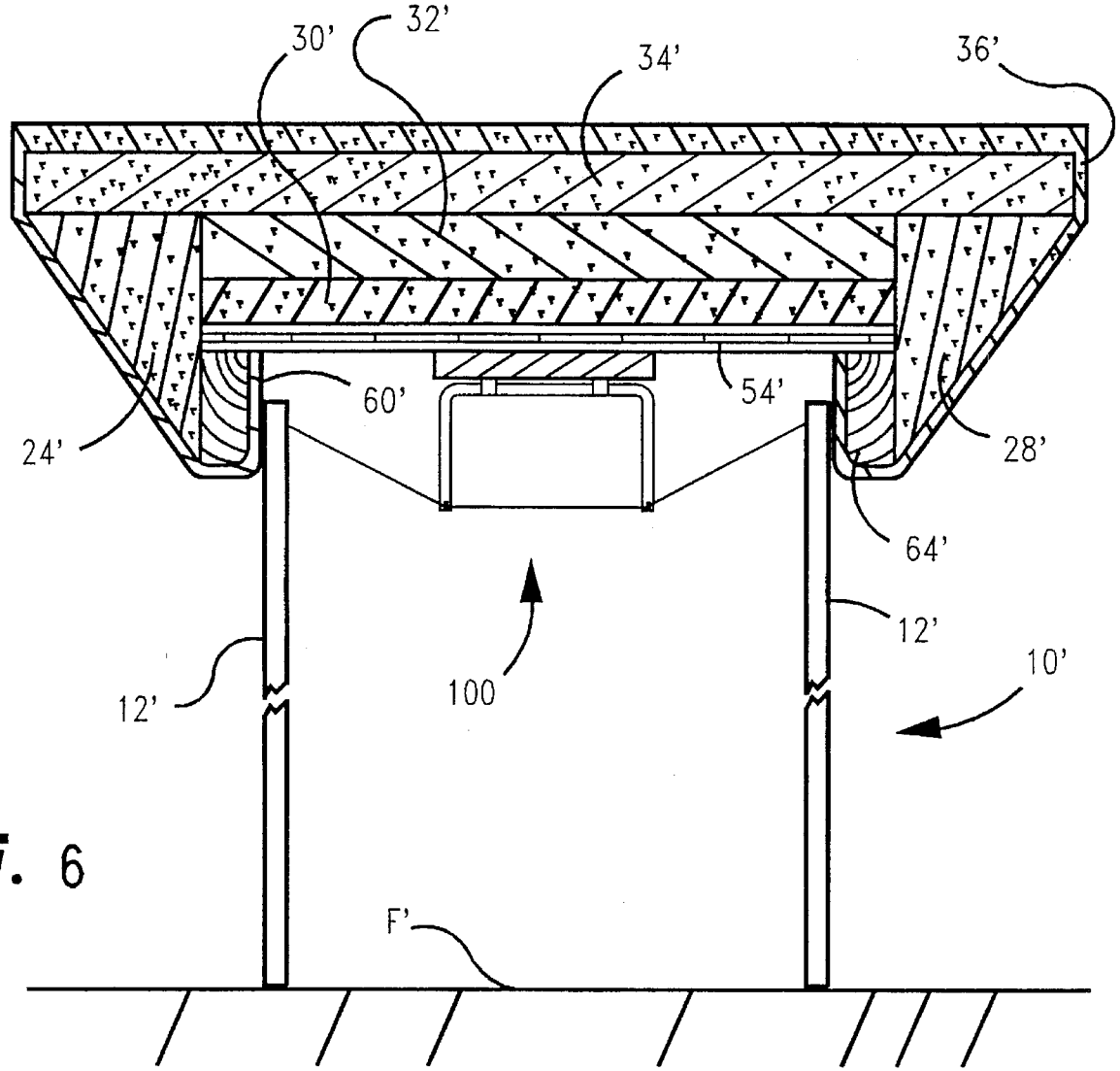
FIG. 6 is a cross-sectional view of another embodiment of a massage table in accordance with the present invention.

The table top 14 preferably includes table sections 16 and 18 connected to one another by hinges 20 so that the table 10 may be folded for ease of transportation and storage. The table section 16 may include a frame 22, wedge-shaped members 24, 26, and 28, padding sections 30, 32, and 34, and a covering 36. The table section 18 is preferably identical to the table section 16 and includes frame 38, wedge-shaped members 40, 42, and 44, padding sections 46, 48, and 50, and a covering 52 (FIG. 3).

With reference to FIGS. 2(*a*)–2(*d*) the frame 22 preferably includes a rectangular support member 54 having an upper surface 56 and a lower surface 58, and edge members 60, 62, 64 and 66 which engagably connect to the periphery of the lower surface 58 as by adhesive and fasteners. A preferred adhesive is a spray adhesive known as 3M-74 available from 3M. The rectangular support member 54 is preferably provided by a sheet of birch plywood having a thickness from about 3 mm to about 6 mm and the edge members are preferably provided by a strong, light-weight wood material, such as 1 19/32 inch×19/32 inch Poplar board.

The wedge- shaped members 24, 26 and 28 are preferably triangular in cross-section, however, it will be understood that other shapes may be used. In addition, the members 24, 26 and 28 are preferably made of high density polyurethane having a density of about 2.2 lbs/ft$^3$ and a compression of about 110 lbs, wherein the compression signifies the weight required to compress a 15 inch×15 inch×4 inch section of the pad 25% when centrally placed thereon. As will be explained more fully below, the wedge members 24, 26 and 28 enable the surface area of the table top to be significantly increased without a significant increase in the weight of the table. For example, wedge members 24, 26 and 28 each have a width W of about 2⅝ inches and a height H of about 2⅞ inches. However, various wedge dimensions may be used depending on various therapy considerations. Accordingly, a gain of 4 or more inches in length and width of the table may be readily achieved with very little gain in weight. This as well as numerous other advantages of the present invention will be explained more fully below.

With further reference to FIGS. 2(*b*) and 2(*c*), a lower surface of the pad 30 may be secured, as by adhesive, to the upper surface of the support member 54, and the pad 32 adhesively secured on top of the pad 30. The edges of the pads 30 and 32 may then be trimmed so that they are flush with the edges of the support member to facilitate attachment of the wedge members 24–28. The pads 30 and 32 are preferably polyurethane foam corresponding in size to the upper surface of the support member 54 and having thicknesses of ½ and ¾ inches, respectively. Preferably, the pad 30 has a density of about 2.2 lbs/ft$^3$ and a compression of about 20 lbs, and the pad 32 has a density of 1.4 lbs/ft$^3$ and a compression of 44 lbs.

The wedge members 24, 26 and 28 may then be installed by adhering adjacent edges of the wedge members 24, 26 and 28 to one another and by adhering portions of the wedge members 24, 26 and 28 to the edge members 60, 62, and 64, respectively, and to corresponding peripheral edges of the support member 54 and of the pads 30 and 32. For example, wedge member 28 has a lowermost edge 68 and side 70, edge member 62 has a front surface 72 and lowermost edge 74, the support member 54 has a peripheral edge 76 immediately above the front surface 72 of the edge member 62, the pad 30 has a peripheral edge 77, and the pad 32 has peripheral edge 78. To secure the wedge member 28 to the frame 22 and the pads 30 and 32, adhesive is preferably applied to mating portions of the side 70, the front surface 72 and the edges 76, 77 and 78. The side 70 of the wedge member may be placed against the front surface 72 and the edges 76, 77 and 78 with the lowermost edge 68 of the wedge member 28 aligned with and parallel to the lowermost edge 74 of the edge member 62. The wedge members 26 and 24 may be secured in a similar manner.

It is noted that the height H of each wedge-shaped member is about 2⅞ inches, while the support member 54 has a thickness of from about 3 to about 6 mm and the edge member 62 has a height of about 1 19/32 inch. Thus, the upper horizontal surface of each wedge member 24, 26 and 28 will be parallel to but spaced about 1¼ inches above the upper surface 56 of the support member 54, but flush with the upper surface of the pad 32.

With reference to FIG. 2(*d*), the pad 34 is also preferably polyurethane foam and is sized to correspond in length and width to the frame/wedge member assembly. The pad 34 preferably has a thickness of about ¾ inch, a density of about 1.1 lb/ft$^3$ and a compression of about 20 lb. The pad 34 may be adhesively secured to the top of the pad 32 and the upper surfaces of the wedge members. Following installation of the pad 34, the covering 36 may installed. For example, the covering 36 is preferably a vinyl covering which may be stretched over the pad 34, wedge members 24, 26 and 28, and edge members 60, 62, 64 and 66, and secured in the stretched configuration as by stables 80 or other fasteners inserted through edge portions of the covering and into interior surfaces of the edge members adjacent the lower surface 58 of the support surface 56.

Numerous advantages are achieved by the table of the present invention. As mentioned above, a significant increase in table surface may be achieved with only a small increase in weight by reducing-the frame size and the amount of wood needed for a given size table. For example, a conventional massage table having a table section that is 29 inches×73 inches is constructed using a wood frame which is 28 inches×72 inches with a 28 inch×72 inch foam pad and additional ½ inch wide strips of foam on the sides and ends. To the contrary, the present invention enables a massage table having a table section that is 29 inches×73 inches to be constructed using a wood frame 22 that is only 24 inches×68 inches. Thus, significant weight savings of from about 1 to about 3 pounds may be achieved, depending on the thickness of the wood, by the use of the smaller frame while still achieving the benefits of a larger table surface.

In addition to the significant weight savings, additional benefits include table edges which are more compatible with massage techniques and provide improved comfort. For example, the masseuse may lean on and deform a portion of the foam wedges 24, 26 and 28 to enable the masseuse to get closer to the recipient of the massage therapy or to enable the masseuse to brace himself and thereby facilitate the therapy. Alternatively and with reference to FIG. 5, the foam wedges 24–28 and 40–44 may include cutout sections, such as cutout sections 82 which are configured to receive a leg or hip of the masseuse to enable the masseuse to get closer to the recipient of the massage therapy and/or brace himself, cutout section 84 configured to receive the head/neck of the recipient of the massage therapy, and cutout sections 86 configured, for example, to receive the feet/ankles of the therapy recipient for improved comfort while lying on the table 10.

The wedges 24, 26 and 28 also advantageously enable the legs 12 of the table 10 to be placed further away from the edges of the table such that the masseuse is less likely to bump against the legs of the table during massage therapy. In addition, it has been discovered that the edges of the table provided by the foam wedges 24, 26 and 28 offer improved comfort and provide an edge which is easier to grip than the edges of conventional massage tables and thus may be more easily grasped by a user when climbing onto or off of the table.

Turning now to FIGS. 6–11, there is shown another embodiment of a massage table 10' provided in accordance with the present invention. For ease of reference, elements corresponding to previously described elements will be described with the same characters using a prime suffix.

The massage table 10' is identical to the table 10 described previously, except that it further includes a tensioning system 100 which enables the use of a support member 54' that may be lighter and thinner than the support member 54 for further reduction in weight of the massage table. In a preferred embodiment, this is achieved by the use of cables which diagonally connect two or more points about the perimeter and cross one another proximate the center of the table top. An upright member mounted on a thin interior sheet of plywood adjacent the lower surface of the table top and the intersecting region of the cables transfers force from the tensioned cables so that the interior sheet of plywood is compressed against the lower surface of the table top to rigidify and increase deflectional resistance of the table top.

Figure 7:
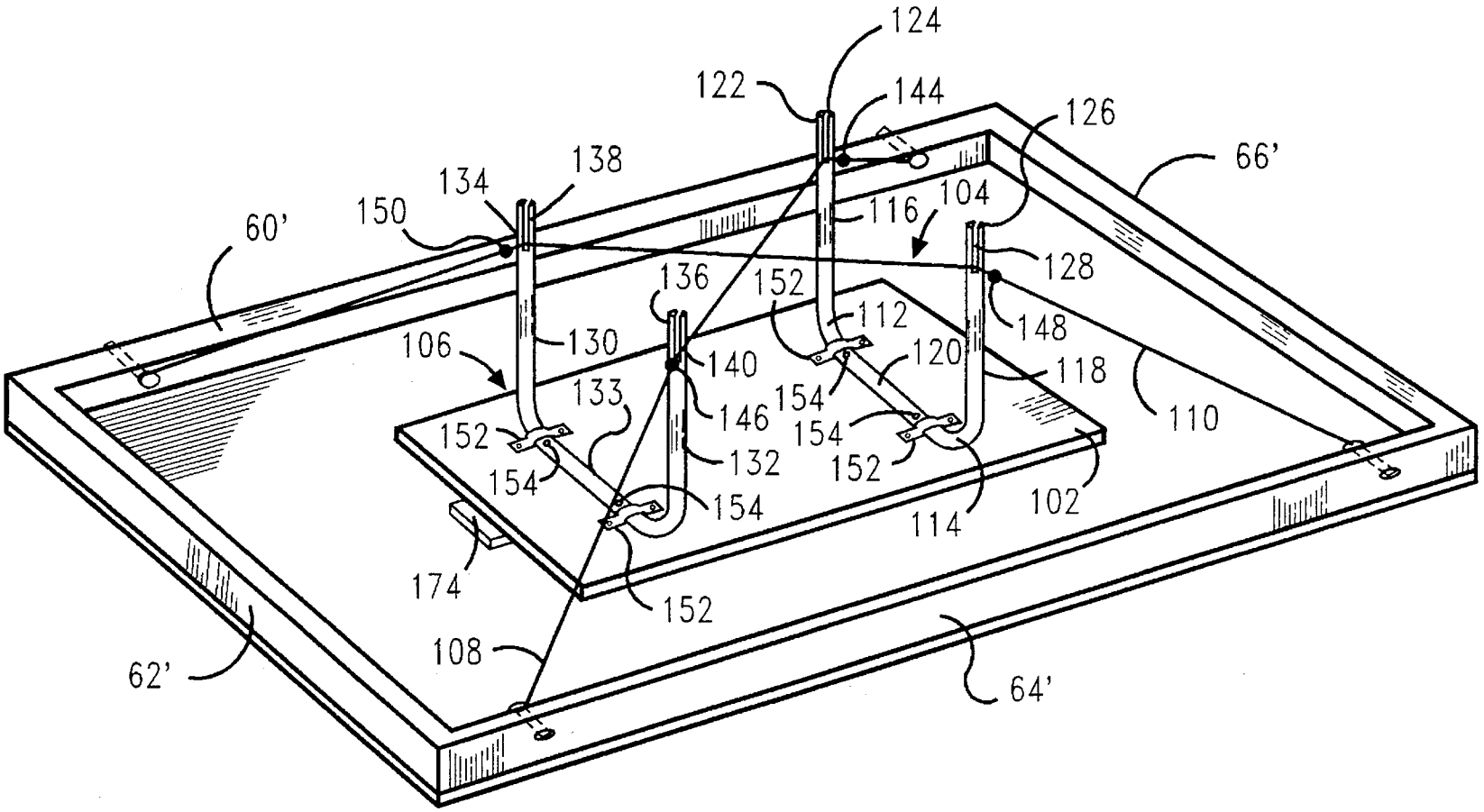
FIG. 7 is a bottom perspective view of the massage table of FIG. 6.
Figure 8:
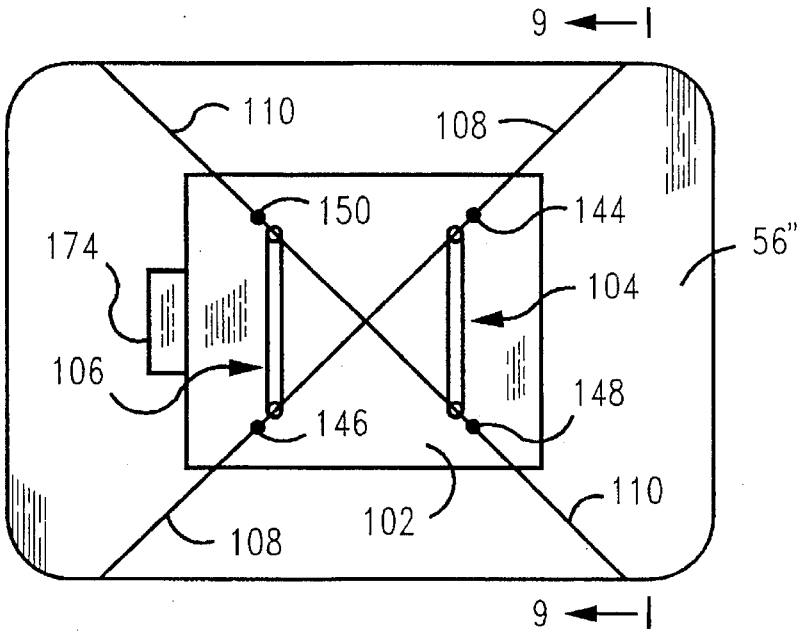
FIG. 8 is a bottom plan view of the table of FIG. 7.
Figure 9:
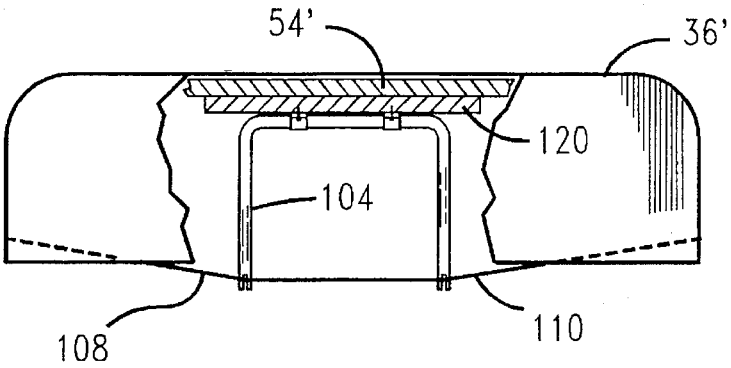
FIG. 9 is a partial cross-sectional view taken along line 9—9 of FIG. 8.
Figure 10:
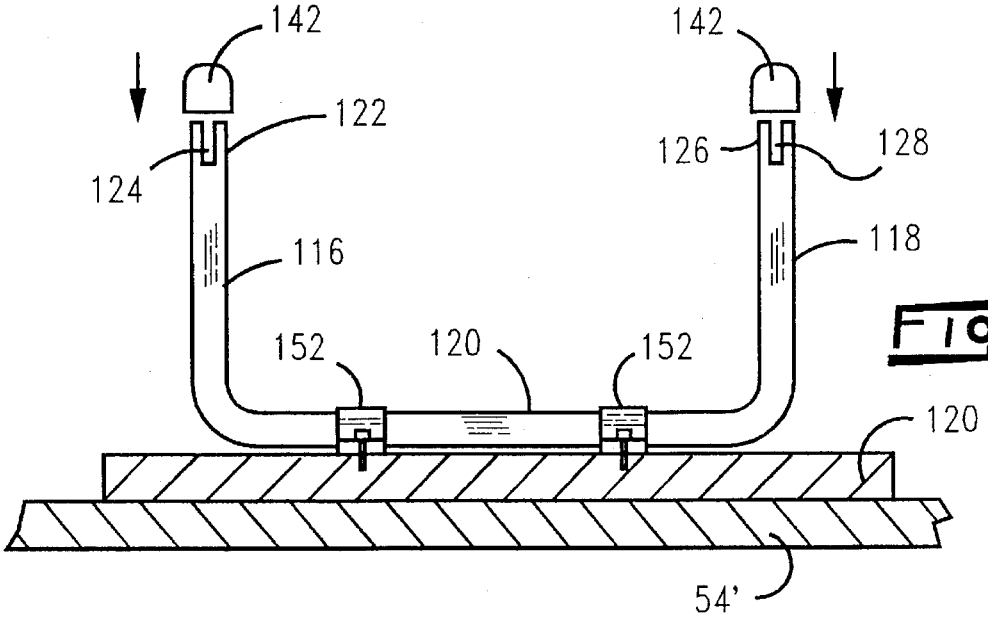
FIG. 10 is an enlarged, close-up view of FIG. 9.

With reference to FIG. 7, the support system 100 includes a slide member 102, U-shaped tensioning members 104 and 106, and tensioning cables 108 and 110, the free ends of which may be attached to the edge members of the frame as by fasteners 111. The slide member 102 is preferably provided by a sheet of 3 mm birch plywood and the cables 108 and 110 are preferably 7×7 strand 3/32 inch galvanized cables. For a frame 22' that is 24 inches×68 inches, the slide member 22' is preferably about 14 inches×14 inches and each cable 108 and 110 is preferably about 36 inches in length.

The U-shaped member 104 may be provided by 3/8 inch o.d. aluminum tubing having an overall length of about 17 inches and bent at curves 112 and 114 to provide upright sections 116 and 118 each having a length of about 3½ inches and a connecting section 120 having a length of about 10 inches. The U-shaped member 106 is preferably identical in construction to the U-shaped member 104.

The upright section 116 of the member 104 includes an upper end 122 having a slot 124 defined therethrough for receiving the tensioning cable 108 and the upright section 118 includes an upper end 126 having a slot 128 defined therethrough for receiving the tensioning cable 110. Likewise, U-shaped member 106 includes upright sections 130 and 132 on opposite ends of connecting section 133. The upright sections 130 and 132 have ends 134 and 136 with slots 138 and 140 for receiving the cables 108 and 110, respectively. Caps 142 may be provided to fit over the upper ends of each upright section to prevent disengagement of the cables 108 and 110 from the slots. Cable stops 144 and 146 are provided on the cable 108 outside of the slots 128 and 138, respectively to limit travel of the cable 108 through the slots 128 and 138 and cable stops 148 and 150 are provided on the cable 110 outside of the slots 124 and 140, respectively to limit travel of the cable 110 through the slots 124 and 140, as explained more fully below.

The U-shaped members 104 and 106 may be rotatably mounted to the sliding member 102 by use of U-shaped clamps 152 which encircle the connecting section 120 to enable the connecting section to rotate. The clamps 152 may be secured to the sliding member 102 as by wood screws which pass through apertures on opposite sides of the clamp 138. Stops 154 are provided on locations on the connecting sections 120 and 133 interior to the clamps 152 to prevent longitudinal sliding of the connecting section 120 of the U-shaped member 104.

Figure 11:
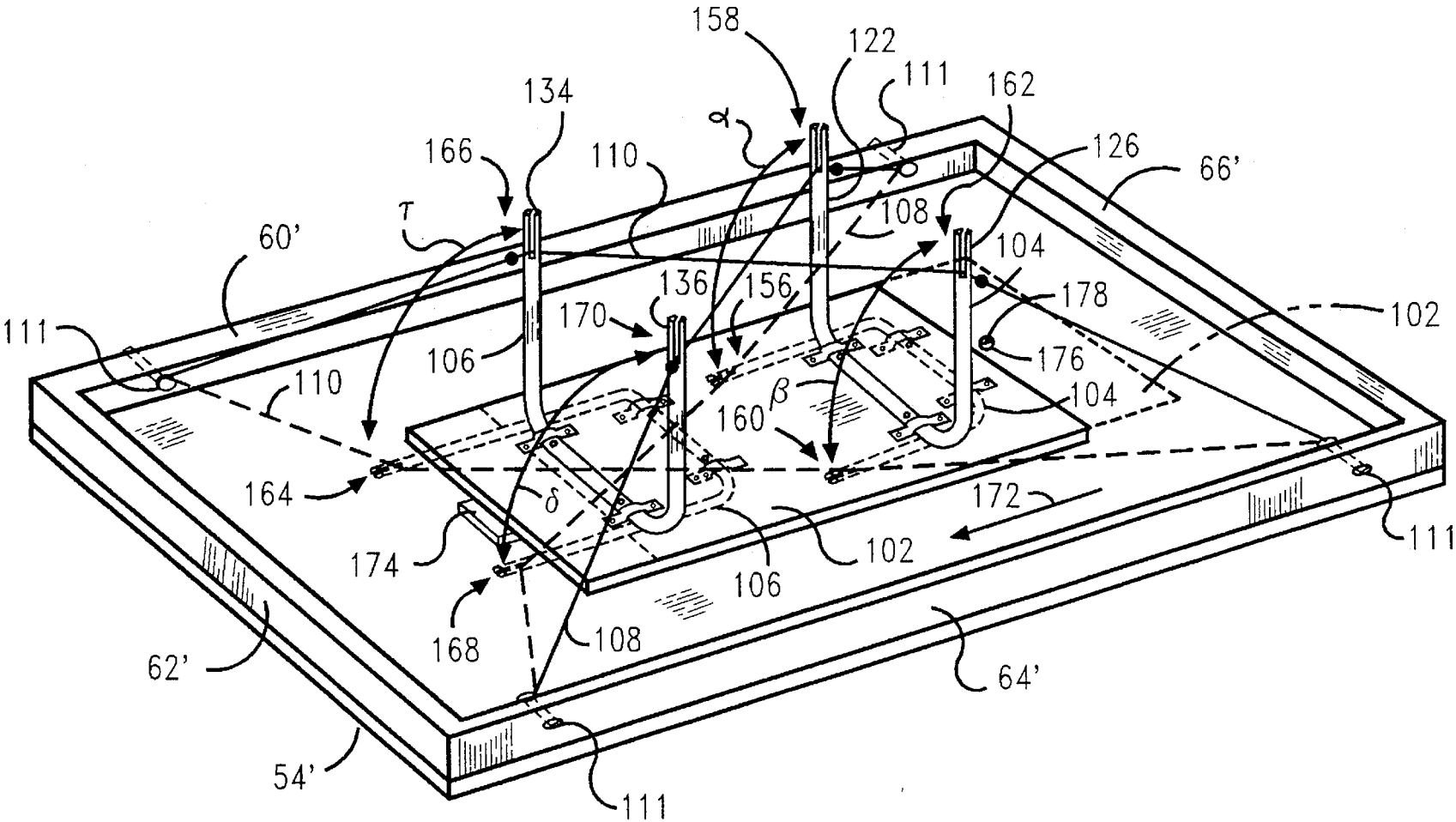
FIG. 11 is another perspective view of the table of FIG. 7 showing operation of the tensioning system.

With additional reference to FIG. 11, the tensioning system 100 may be used to tension the frame and thereby urge the slide member 102 against the support member 54 to enable the use of a support member 54' that may be lighter and thinner than the support member 54 for further reduction in weight of the massage table without a corresponding decrease in rigidity. For example, it has been discovered that a 3 mm thick sheet of plywood may be used in place of a heavier 6 mm thick sheet of plywood without compromising the rigidity of the table and its suitability for use with various massage techniques.

As shown in FIG. 11, the end 122 of the upright section 116 is positionable through an arc $\alpha$ defined between a point 156 adjacent the upper surface of the slide member and a point 158 which is spaced apart from the point 156 in a direction which is generally away from the outer planar surface of the slide member. The end 126 of the upright section 118 is similarly positionable through an arc $\beta$ which is generally parallel to the arc $\alpha$ and defined between a point 160 adjacent the upper surface of the slide member and a point 162 which is spaced apart from the point 160 in a direction which is generally away from the outer planar surface of the slide member.

Likewise, the end 134 of the upright section 130 is positionable through an arc $\tau$ defined between a point 164 adjacent the upper surface of the slide member and a point 166 which is spaced apart from the point 164 in a direction which is generally away from the outer planar surface of the slide member. Similarly, the end 136 of the upright section 132 is positionable through an arc $\delta$ which is generally parallel to the arc $\tau$ and defined between a point 168 adjacent the upper surface of the slide member and a point 170 which is spaced apart from the seventh point in a direction which is generally away from the outer planar surface of the slide member.

To tension the cables 108 and 110, the slide member may be moved in the direction of the arrow 172 toward a stop 174 such that the ends 122 and 128 follow paths corresponding to the arcs $\alpha$ and $\beta$, respectively. In other words, the end 122 travels in a direction toward the point 158 and the end 128 travels in a direction toward the point 162. Likewise, the ends 134 and 136 follow paths corresponding to the arcs $\tau$ and $\delta$, respectively; the end 134 traveling in a direction toward the point 166 and the end 136 traveling in a direction toward the point 170.

Once the slide member has traveled sufficiently such that it is urged against the stop 174, the cables 108 and 110 are sufficiently tensioned such that sufficient pressure is supplied from the cables through the slide member to the upper support to tension the frame and render the upper support more resistant to deflection so that a thinner support member may be used. The tension in the cables is also sufficient to maintain the U-shaped members in the erected orientation, however, for added security, a removable stop 176, such as a pin, may be inserted into aperture 178 to prevent the slide member from moving away from the top 174. To untension the cables 108 and 110, the stop 176 may be removed and the slide member urged away from the stop 174 so that the ends travel back through their respective arcs in the opposite direction.

Figure 12:
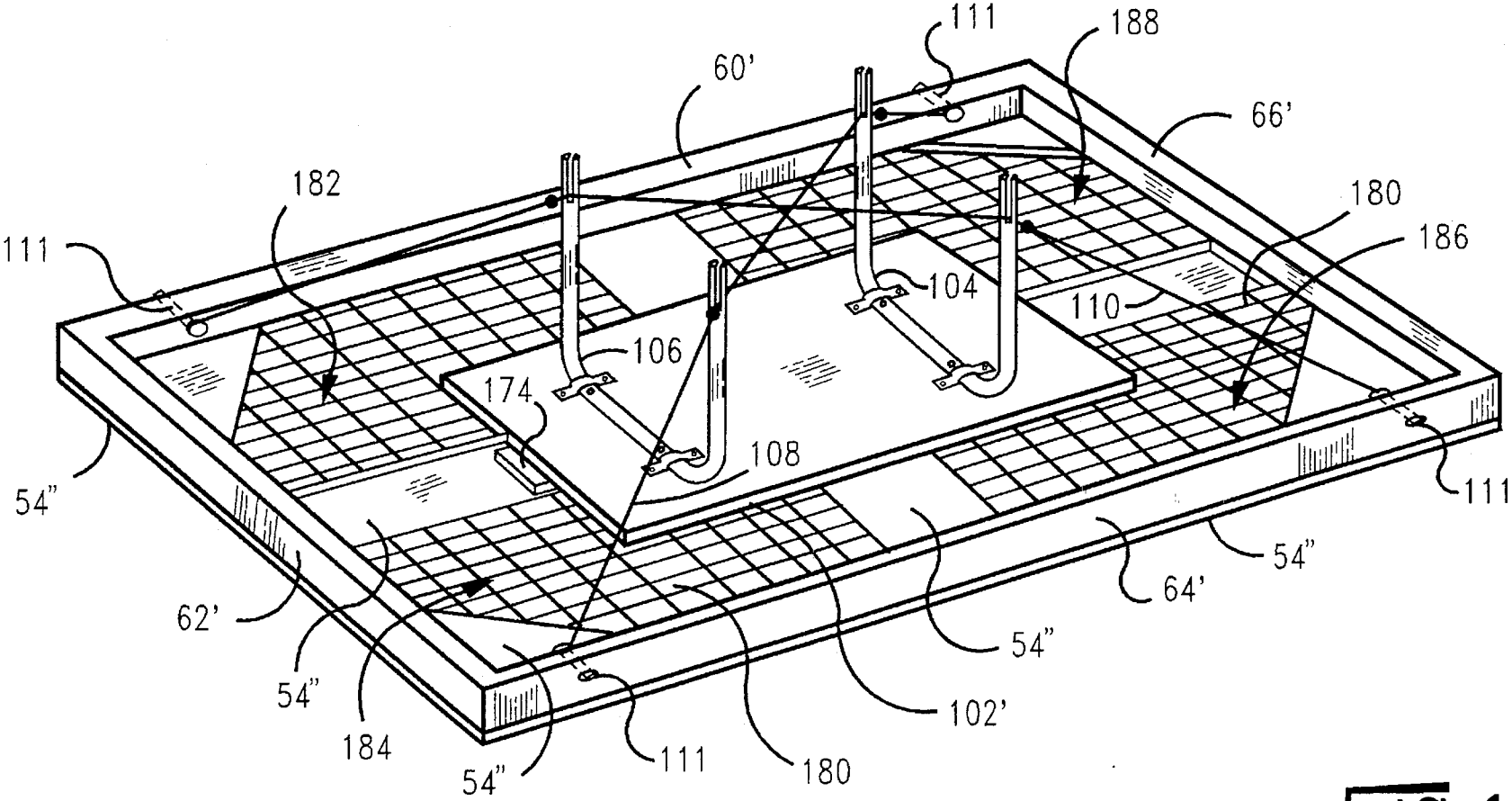
FIG. 12 is a perspective bottom of another embodiment of a table having a fabric top.

FIG. 12 shows another embodiment of a massage table 10" which includes the tensioning system 100. The table 10" is identical to the table 10', except it includes a support member 54" that is even lighter than the support member 54'. As will be apparent, the removed sections 180, 182, 184, and 186 provide a significant reduction in weight. A high strength, light-weight fabric covering 180, preferably a polymer fabric, is tightly stretched over the frame 22" and secured to the frame as by staples or other fasteners. The support member 54" is preferably provided by a rectangular section of plywood having sections 182, 184, 186, and 188 removed therefrom.

The tension system 100 enables the use of a support member 54' that may be lighter and thinner than the support member 54 for further reduction in weight of the massage table without a decrease in rigidity. It will also be understood that various other cable arrangements, and cable attachment and tensioning arrangements may be utilized to tension the frame and to compress the slide member against the lower surface of the support member.

Figure 13:
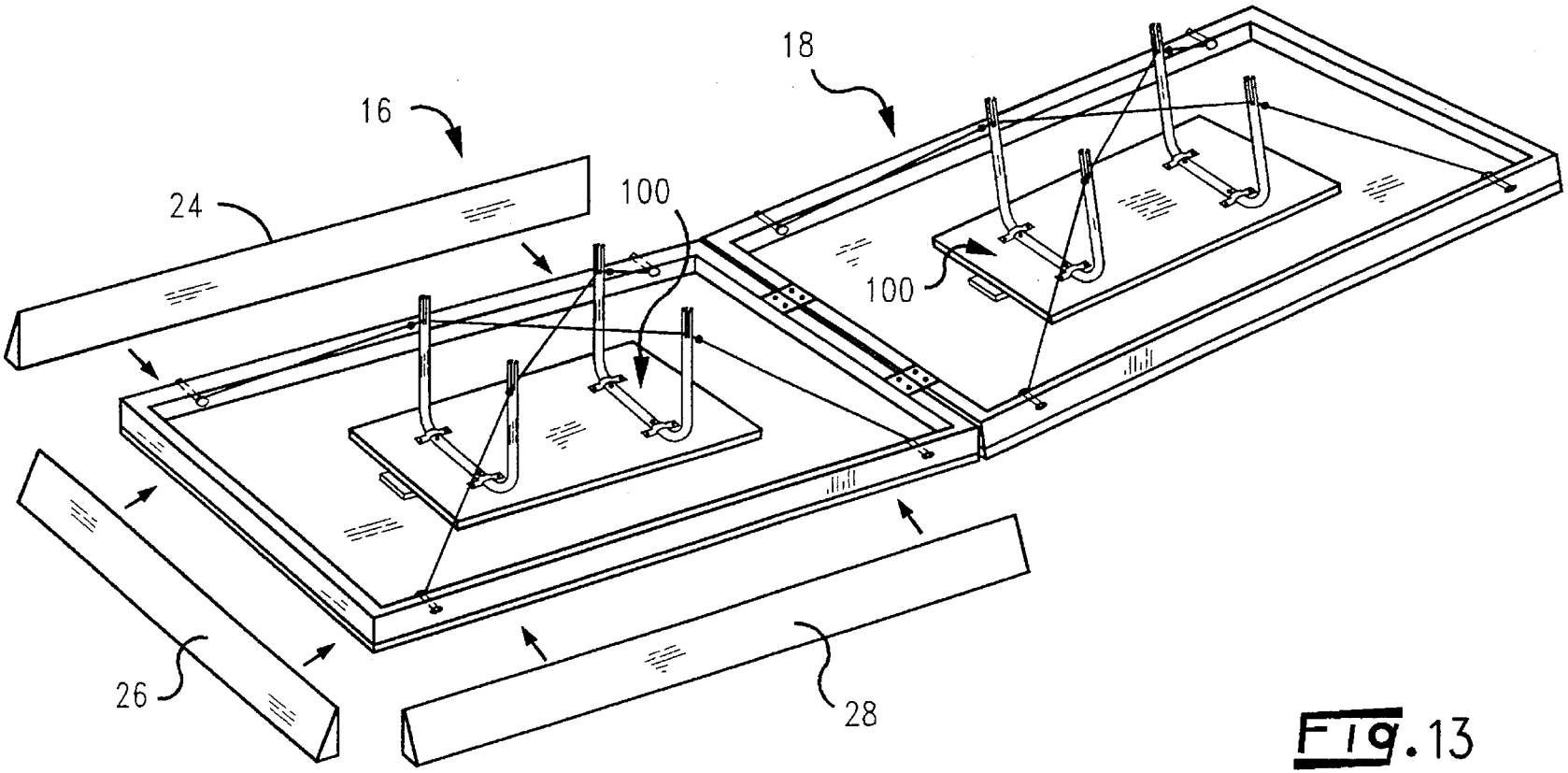
FIG. 13 is a perspective view of a table in accordance with the present invention having elongated triangular cross-section edge padding and tensile members in accordance with the present invention.
Figure 14:
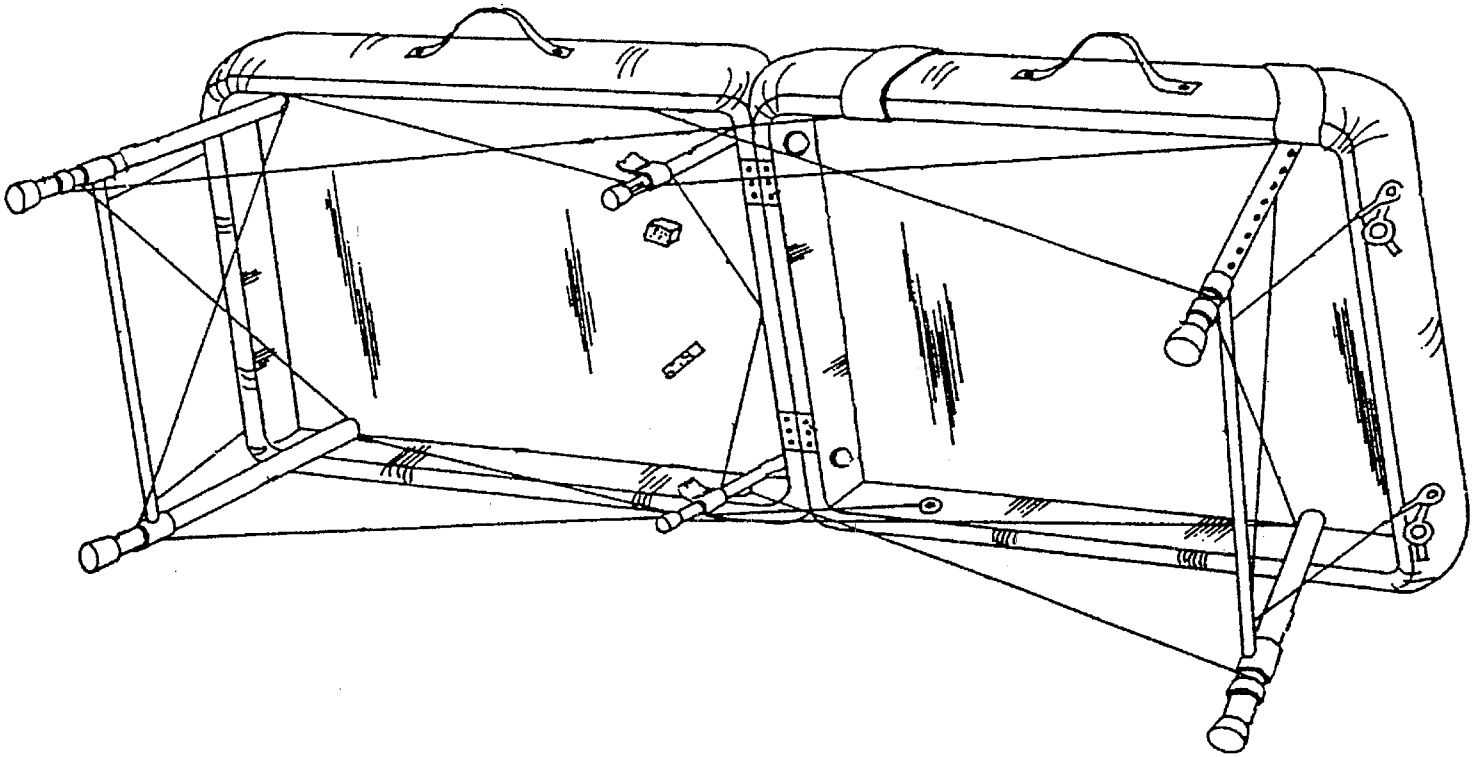
FIG. 14 PRIOR ART
FIG. 14 is a perspective view of a massage table described in U.S. Pat. No. 4,943,041.
Figure 15:
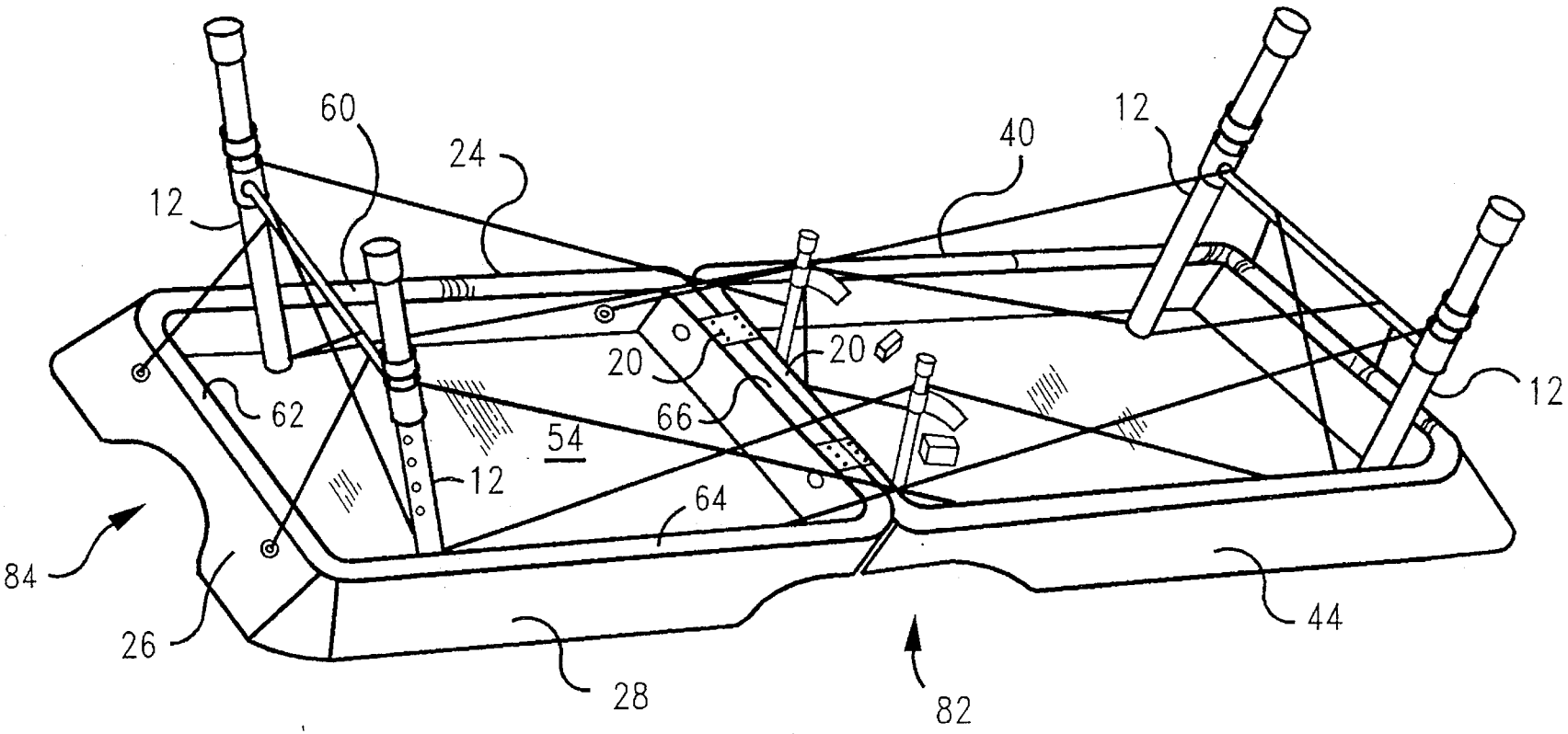
FIG. 15 is a perspective view of the table of FIG. 14 having included therewith a table top having elongated triangular cross-section edge padding provided in accordance with the present invention.
Figure 17:
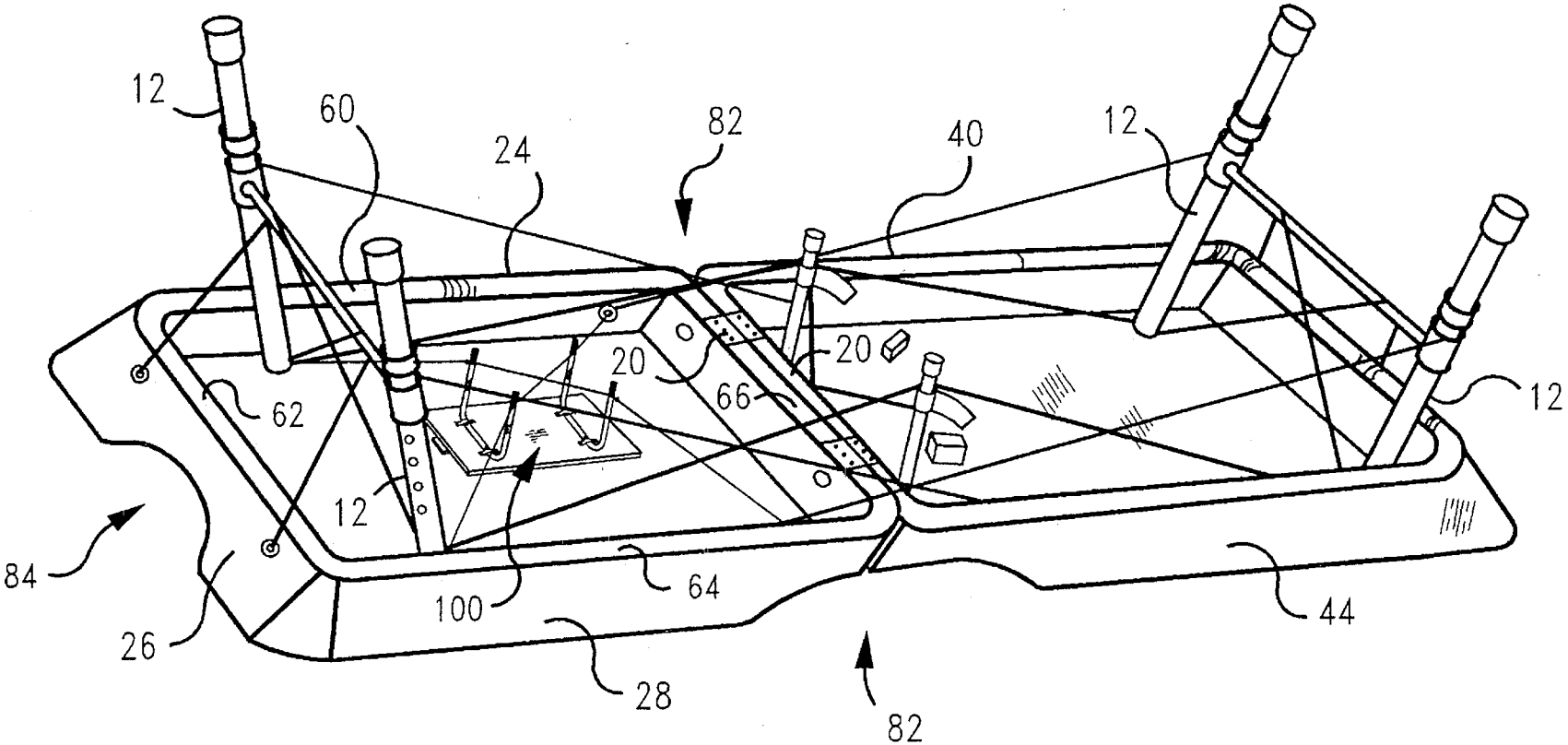
FIG. 17 is a perspective view of the table of FIG. 14 having included therewith a table top having elongated triangular cross-section edge padding and a tensioning system provided in accordance with the present invention.

Further advantages may be achieved by combining the table construction of table 10 with the tension system 100 described in connection with table 10', such as is shown in FIG. 13. The table construction of the present invention may also advantageously include the adjustable/foldable leg assembly and support cable configuration described in Applicant's U.S. Pat. No. 4,943,041, entitled LIGHT-WEIGHT FOLDING MASSAGE TABLE, the entire disclosure of which is incorporated herein by reference. FIG. 14 shows the table of the '041 patent and FIGS. 15–17 show embodiments of the present invention utilizing the adjustable/foldable leg assembly and support cable configuration of the '041 patent.

The foregoing description of certain embodiments of the present invention has been provided for purposes of illustration only, and it is understood that numerous modifications or alterations may be made without departing from the spirit and scope of the invention as defined in the following claims.

What is claimed is:

1. A massage table, comprising:

a plurality of legs and a table top supported by the legs, said table top comprising:

a frame comprising a planar support member having an upper surface and a lower surface, and a plurality of edge members adjacent to a peripheral edge of the lower surface of the support member, each of said edge members having a lower longitudinal edge and a length axis; p1 a plurality of elongated wedge-shaped padding members, each of said wedge members being positioned adjacent to one of the edge members, said wedge-shaped members each having a length axis aligned with the length axis of the adjacent edge member, a lower longitudinal edge adjacent to and aligned with the lower longitudinal edge of the adjacent edge member, and an upper surface positioned parallel to and above the upper surface of the support member;

first padding means having a lower surface positioned adjacent to and overlying the upper surface of the support member and an upper surface spaced apart from the lower surface thereof and substantially aligned with and parallel to the upper surface of each of the wedge-shaped padding members;

second padding means having a lower surface positioned adjacent to and overlying the upper surface of the first padding means and the upper surface of each of the wedge-shaped padding members; and a covering positioned in overlying contact against substantially all of said second padding means, at least a portion of each of said wedge shaped members, and at least a portion of each of said edge members.

2. The massage table of claim 1, wherein said second padding means further includes an upper surface spaced apart from the lower surface of the second padding means, the upper surface of the second padding means being substantially planar.

3. The massage table of claim 1, wherein at least a portion of the upper surface of at least one of the wedge-shaped members is cutout to provide a recess.

4. The massage table of claim 1, wherein the support member comprises a rectangular piece of plywood and the first padding means comprises a pair of rectangular pieces of polyurethane foam each having a surface area corresponding to that of the support member.

5. The massage table of claim 1, wherein each of said wedge-shaped members comprises an elongate portion of polyurethane foam having a triangular cross-section, wherein one leg of the triangle is positioned adjacent one of the edge members and the other leg of the triangle provides the upper surface of the wedge-shaped member.

6. The massage table of claim 1, wherein said wedge-shaped members and said first and second padding members are resilient.

7. The massage table of claim 1, wherein said wedge-shaped members are made of polyurethane foam.

8. The massage table of claim 3, wherein two of the table tops are hingedly connected.

9. The massage table of claim 1, wherein said legs are foldable relative to the upper support member and are of adjustable length.

10. The massage table of claim 1, wherein said wedge-shaped members have a triangular cross-section.

11. A massage table, comprising:

a plurality of legs and a table top supported by the legs, said table top comprising:

a frame comprising a support member having an upper surface and a lower surface, and a plurality of edge members engagably connectable to a peripheral edge of the lower surface of the support member; and tensioning means for tensioning the frame to increase the rigidity of the frame; said tensioning means comprising:

a slide member having an inner planar surface slidably mountable adjacent the lower surface of the support member and an oppositely facing outer surface;

a stop for limiting movement of the slide member relative to the frame in a desired direction;

a first elongate tensioning member having an end;

first mounting means for rotatably mounting the first tensioning member to the slide member so that said end of the first tensioning member is positionable through a first arc defined between a first point adjacent the upper surface of the slide member and a second point which is spaced apart from the first point in a direction which is generally away from the outer planar surface of the slide member;

a second elongate tensioning member having an end;

second mounting means for rotatably mounting the second tensioning member to the slide member at a location spaced apart from the first tensioning member so that said end of the second tensioning member is positionable through a second arc defined between a third point adjacent the outer surface of the slide member and a fourth point which is generally away the outer planar surface of the slide member;

a tensioning cable having a first end secured to the frame at a first securement location and a second end secured to the frame at a second securement location;

a first cable receptacle defined adjacent the end of the first tensioning member for slidably receiving a first portion of the cable;

a second cable receptacle defined adjacent the end of the second tensioning member for slidably receiving a second portion of the cable;

limiting means operatively associated with the first and second cable receptacles and the cable for limiting sliding of the cable relative to the first and second cable receptacles, wherein when the end of the first tensioning member is rotated in the first arc in a direction toward the second point of the first arc and the end of the second tensioning member is rotated in the second arc in a direction toward the fourth point of the second arc, the slide member is urged against the stop and the cable is tensioned such that pressure is supplied from the cable through the slide member to the upper support to tension the frame and render the supper support more resistant to deflection, and wherein when the end of the first tensioning member is rotated in the first arc in a direction toward the first point of the first arc and the second tensioning member is rotated in the second arc in a direction toward the third point of the second arc, the slide member is urged away from the stop tension is relieved from the cable.

12. The massage table of claim 11, wherein said support member comprises a rectangular piece of plywood and said slide member comprises a smaller rectangular piece of plywood.

13. The massage table of claim 11, wherein the first cable securement location is spaced apart from the second cable securement location.

14. A massage table, comprising:

a plurality of legs and a table top supported by the legs, said table top comprising:

a frame comprising a support member having an upper surface and a lower surface, and a plurality of edge members engagably connectable to a peripheral edge of the lower surface of the support member; and tensioning means for tensioning the frame to increase the rigidity of the frame; said tensioning means comprising:

a slide member having an inner planar surface slidably mountable adjacent the lower surface of the support member and an oppositely facing outer surface;

a stop for limiting movement of the slide member relative to the frame in a desired direction;

a first U-shaped tensioning member comprising an elongate member bent at curves adjacent the opposite ends thereof to provide first and second upright sections and a connecting section between the first and second upright sections, the first upright section terminating at first end and the second upright section terminating at a second end;

first mounting means for rotatably mounting the first tensioning member to the slide member so that the first end of the first upright section of the first tensioning member is positionable through a first arc defined between a first point adjacent the upper surface of the slide member and a second point which is spaced apart from the first point in a direction which is generally away from the outer planar surface of the slide member and the second end of the second upright section of the first tensioning member is positionable through a second arc parallel to the first arc and defined between a third point adjacent the upper surface of the slide member and a fourth point which is spaced apart from the third point in a direction which is generally away from the outer planar surface of the slide member;

a second U-shaped tensioning member comprising an elongate member bent at curves adjacent the opposite ends thereof to provide third and fourth upright sections and a connecting section between the third and fourth upright sections, the third upright section terminating at a third end and the fourth upright section terminating at a fourth end;

second mounting means for rotatably mounting the second tensioning member to the slide member so that the third end of the third upright section is positionable through a third arc defined between a fifth point adjacent the upper surface of the slide member and a sixth point which is spaced apart from the fifth point in a direction which is generally away from the outer planar surface of the slide member and the fourth end of the fourth upright section is positionable through a fourth arc parallel to the third arc defined between a seventh point adjacent the upper surface of the slide member and an eighth point which is spaced apart from the seventh point in a direction which is generally away from the outer planar surface of the slide member;

a first tensioning cable having a first end secured to the frame at a first securement location and a second end secured to the frame at a second securement location;

a second tensioning cable having a first end secured to the frame at a third securement location and a second end secured to the frame at a fourth securement location;

a first cable receptacle defined adjacent the first end of the first tensioning member for slidably receiving a first portion of the first cable;

a second cable receptacle defined adjacent the third end of the second tensioning member for slidably receiving a second portion of the first cable;

a third cable receptacle defined adjacent the second end of the first tensioning member for slidably receiving a first portion of the second cable;

a fourth cable receptacle defined adjacent the fourth end of the second tensioning member for slidably receiving a second portion of the second cable;

limiting means operatively associated with the first, second, third and fourth cable receptacles and the first and second cables for limiting sliding of the first and second cables relative to the first, second, third and fourth cable receptacles, wherein when the first and second ends of the first tensioning member are rotated in the first and second arcs in a direction toward the second point of the first arc and the fourth point of the second arc, respectively, and the third and fourth ends of the second tensioning member are rotated in the third and fourth arcs in a direction toward the sixth and eighth points of the second arc, respectively, the slide member is urged against the stop and the first and second cables are tensioned such that pressure is supplied from the first and second cables through the slide member to the upper support to tension the frame and render the upper support more resistant to deflection, and wherein when the first and second ends of the first tensioning member are rotated in the first and second arcs in a direction toward the first and third points of the first arc and the third and fourth ends of the second tensioning member are rotated in the second arc in a direction toward the fifth and seventh points of the second arc, the slide member is urged away from the stop tension is relieved from the first and second cables.

15. The masssage table of claim 14, wherein the support member comprises a rectangular piece of plywood and said slide member comprises a smaller rectangular piece of plywood.

16. A massage table, comprising:

a plurality of legs and a table top supported by the legs, said table top comprising:

a frame comprising a support member having an upper surface and a lower surface, and a plurality of edge members adjacent to a peripheral edge of the lower surface of the support member, each of said edge members having a lower longitudinal edge and a length axis;

a plurality of wedge-shaped padding members, each of said wedge members being positioned adjacent to one of the edge members, said wedge-shaped members each having a length axis aligned with the length axis of the adjacent edge member, a lower longitudinal edge adjacent to and aligned with the lower longitudinal edge of the adjacent edge member, and an upper surface positioned parallel to and above the upper surface of the support member;

first padding means having a lower surface positioned adjacent to and overlying the upper surface of the support member and an upper surface spaced apart from the lower surface thereof and substantially aligned with and parallel to the upper surface of each of the wedge-shaped padding members;

second padding means having a lower surface positioned adjacent to and overlying the upper surface of the first padding means and the upper surface of each of the wedge-shaped padding members; and a covering positioned in overlying contact against substantially all of said second padding means, at least a portion of each of said wedge shaped members, and at least a portion of each of said edge members; and tensioning means for tensioning the frame to increase the rigidity of the frame; said tensioning means comprising:

a slide member having an inner planar surface slidably mountable adjacent the lower surface of the support member and an oppositely facing outer surface;

a stop for limiting movement of the slide member relative to the frame in a desired direction;

a first elongate tensioning member having an end;

first mounting means for rotatably mounting the first tensioning member to the slide member so that said end of the first tensioning member is positionable through a first arc defined between a first point adjacent the upper surface of the slide member and a second point which is spaced apart from the first point in a direction which is generally away from the outer planar surface of the slide member;

a second elongate tensioning member having an end;

second mounting means for rotatably mounting the second tensioning member to the slide member at a location spaced apart from the first tensioning member so that said end of the second tensioning member is positionable through a second arc defined between a third point adjacent the outer surface of the slide member and a fourth point which is generally away the outer planar surface of the slide member;

a first tensioning cable having a first end secured to the frame at a first securement location and a second end secured to the frame at a second securement location;

a first cable receptacle defined adjacent the end of the first tensioning member for slidably receiving a first portion of the first cable;

a second cable receptacle defined adjacent the end of the second tensioning member for slidably receiving a second portion of the first cable;

limiting means operatively associated with the first and second cable receptacles and the first cable for limiting sliding of the first cable relative to the first and second cable receptacles, wherein when the end of the first tensioning member is rotated in the first arc in a direction toward the second point of the first arc and the end of the second tensioning member is rotated in the second arc in a direction toward the fourth point of the second arc, the slide member is urged against the stop and the first cable is tensioned such that pressure is supplied from the first cable through the slide member to the upper support to tension the frame and render the supper support more resistant to deflection, and wherein when the end of the first tensioning member is rotated in the first arc in a direction toward the first point of the first arc and the second tensioning member is rotated in the second arc in a direction toward the third point of the second arc, the slide member is urged away from the stop tension is relieved from the first cable.

* * * * *

UNITED STATES PATENT AND TRADEMARK OFFICE

CERTIFICATE OF CORRECTION

PATENT NO. : 5,606,755

DATED : March 4, 1997

INVENTOR(S) : David C. ROMEIN

It is certified that error appears in the above-indentified patent and that said Letters Patent is hereby corrected as shown below:

Column 7, line 49, delete "p1" and begin a new paragraph with "a plurality of".

Column 9, line 5, after "away" insert --from--;

Column 9, line 30, change "supper" to --upper--.

Column 12, line 26, after "away" insert --from--;

Column 12, line 53, change "supper" to --upper--.

Signed and Sealed this

Fifteenth Day of July, 1997

Bruce Lehman

*Attest:*

BRUCE LEHMAN

*Attesting Officer*

*Commissioner of Patents and Trademarks*